US005675210A

United States Patent [19]

Kim

[11] Patent Number: 5,675,210

[45] Date of Patent: Oct. 7, 1997

[54] METHOD OF FABRICATING A FIELD EMISSION DEVICE

[75] Inventor: Jong-min Kim, Seoul, Rep. of Korea

[73] Assignee: Samsung Display Devices Co., Ltd., Suwon, Rep. of Korea

[21] Appl. No.: 509,461

[22] Filed: Jul. 31, 1995

[30] Foreign Application Priority Data

Mar. 29, 1995 [KR] Rep. of Korea ..... 95-6889

[51] Int. Cl.[6] ..... H01J 9/02

[52] U.S. Cl. ..... 313/309; 313/336; 445/24

[58] Field of Search ..... 445/24, 50; 319/309, 319/336

[56] References Cited

U.S. PATENT DOCUMENTS 5,217,401 6/1993 Watanabe et al. ..... 445/24

*Primary Examiner*—Kenneth J. Ramsey

*Attorney, Agent, or Firm*—Foley & Lardner

[57] ABSTRACT

A method of fabricating a field emission device which can facilitate the formation of a micro-tip for emitting electrons by a field effect. The micro-tip is fabricated such that the etching rate differences among the tungsten cathode, the lower titanium adhesive layer and the upper aluminum mask, and the internal stress differences are made to be very large, and thus, tungsten micro-tip is protruded by the internal stress when the adhesive layer and the mask are instantaneously etched. Since the micro-tip size is easily adjusted, and the internal stress of tungsten and characteristics of BOE method are utilized throughout the fabricating process, the reproducibility is ensured.

28 Claims, 9 Drawing Sheets

METHOD OF FABRICATING A FIELD EMISSION DEVICE

BACKGROUND OF THE INVENTION

The present invention relates to a method of fabricating a field emission device which can facilitate the formation of a micro-tip for emitting electrons by a field effect.

As an image display device which can replace the cathode ray tube of existing television receivers, the flat panel display has been under vigorous development for use as an image display device for wall-mounted (tapestry) televisions or high definition televisions (HDTV). Such flat panel displays include liquid crystal devices, plasma display panels or field emission devices, among which the field emission device is widely used due to the quality of its screen brightness and low power consumption.

The structure of a conventional vertical field emission device will now be described with reference to FIG. 1.

The vertical field emission device includes a rear glass substrate 1, a cathode 2 formed on rear glass substrate 1, a field emission micro-tip 4 formed on cathode 2, an insulation layer 3 having a hole 3' on cathode 2 so as to surround micro-tip 4, a gate 5 formed on insulation layer 3 so as to have an aperture 5' allowing electron emission by a field effect toward the upper micro-tip 4, an anode 6 for pulling electrons emitted from micro-tip 4 so as to impinge onto a fluorescent layer 7 with proper kinetic energy, and a front glass substrate 10 having fluorescent layer 7 deposited thereon and anode 6 formed in a striped pattern.

Also, as shown in FIGS. 2A and 2B, a conventional horizontal field emission device has a structure such that cathode 2 and anode 3 are parallel with substrate 1 so as to emit electrons in parallel with substrate 1, unlike the vertical field emission device shown in FIG. 1.

As shown, an insulation layer 3 is formed on a glass substrate 1, and a cathode 2 and an anode 6 are deposited on an insulation layer 3 with a proper spacing. A hole 3' of a proper depth is formed on insulation layer 3 disposed between cathode 2 and anode 6, and a gate electrode 5 is provided within hole 3' controlling the electron emission from cathode 2 to anode 6.

However, in the vertical field emission device using a single tip as shown in FIG. 1, since the flow of electron beams is determined depending on the size of aperture 6' of a gate, a technique for forming a micro-tip of several tens of nanometers is necessary. That is to say, since a highly microfabrication process of a submicron unit is required for forming a gate aperture depending on a tip size (diameter) and a gate aperture size, there are problems in the process uniformity and the yield in the case of application to a large device. Also, in forming a micro-tip, if the aperture, becomes larger, the level of the gate bias voltage becomes higher, thereby necessitating a high voltage.

The horizontal field emission device shown in FIG. 2A has a high yield and a uniform structure in fabrication thereof in contrast with the vertical field emission device. However, the horizontal field effect makes the various applications of electron beam emission difficult. That is to say, since the flow of electron beams is extremely limited to an identical horizontal plane, it is very difficult to apply electron beams.

SUMMARY OF THE INVENTION

To solve the above problems, it is an object of the present invention to provide a method of fabricating a field emission device which can emit electrons uniformly and attain a high yield even for fabricating a large device.

To accomplish the above object, a method of fabricating the field emission device comprises the steps of: sequentially depositing on a rear substrate an adhesive layer formed of a material etchable in a first etching rate with respect to a predetermined etchant, a cathode layer formed of a metal which is not etched by the etchant and having an internal stress with the adhesive layer higher than a predetermined magnitude, and a mask layer formed of a material etchable in a second etching rate lower than the first etching rate with respect to the etchant; forming a triangular mask by patterning the mask layer; forming a potential micro-tip portion by etching the exposed portion of the cathode using the mask; forming an insulating layer on the rear substrate where the mask and the potential micro-tip portion are formed; forming a gate on the insulating layer using a lift-off method; exposing the mask and the potential micro-tip portion by selectively etching the insulating layer using the gate as a mask; forming a micro-tip by protruding the potential micro-tip portion due to the internal stress by etching the adhesive layer and the mask each being below and above the potential micro-tip portion within a predetermined time; and completing the device such that a front substrate where an anode is formed in a striped pattern across the cathode is disposed opposingly to the rear substrate where the micro-tip is formed with a predetermined spacing, the edges of the device are sealed and the internal air is exhausted to then make a vacuum state.

In the present invention, the adhesive layer is preferably formed by depositing titanium or aluminum to a thickness of about 2,000Å.

The cathode layer is preferably formed by depositing tungsten to a thickness of about 1 μm using a DC magnetron sputtering method or an electron beam deposition method.

The mask layer is preferably formed by depositing titanium or aluminum to a thickness of 1,500~2,000 Å using a magnetron sputtering method or the electron beam deposition method.

The mask forming step preferably includes steps of forming a predetermined photoresist mask on the mask layer and etching the photoresist mask using a chlorine-series reactive ion etching method.

Also, the mask is preferably formed by a lift-off method.

The potential micro-tip portion is preferably formed by etching the cathode layer using the mask by means of $CF_4$-$O_2$ plasma.

The gate is preferably formed by depositing a gate layer and etching the same by a photolithographic method.

The micro-tip is preferably formed by a buffered oxide etching (BOE) method.

The BOE method preferably utilizes a solution of HF and NH4F in the ratio of 7 to 1 up to 10 to 1.

Also, to accomplish the above object, another method of fabricating the field emission device according to the present invention comprises the steps of: sequentially depositing on a rear substrate an adhesive layer formed of a material etchable in a first etching rate with respect to a predetermined etchant, a cathode layer formed of a metal which is etched by the etchant and having an internal stress with the adhesive layer higher than a predetermined magnitude, a mask layer formed of a material etchable in a second etching rate lower than the first etching rate with respect to the etchant, an insulating layer, and a gate layer; forming striped gates by patterning the gate layer; selectively etching the insulating layer using the gates as a mask; forming a triangular mask by patterning the mask layer; forming a potential micro-tip portion by etching the exposed portion of the cathode layer using the mask; forming micro-tip by protruding the potential micro-tip portion due to the internal stress by etching the adhesive layer and the mask each being below and above the potential micro-tip within a predetermined time; and completing the device such that a front substrate where an anode is formed in a striped pattern across the cathode is disposed opposingly to the rear substrate where the micro-tip is formed with a predetermined spacing, the edges of the device are sealed and the internal air is exhausted to then make a vacuum state.

In the present invention, the adhesive layer is preferably formed by depositing titanium or aluminum to a predetermined thickness.

The cathode layer is preferably formed by depositing tungsten to a predetermined thickness using a DC magnetron sputtering method or an electron beam deposition method.

The mask layer is preferably formed by depositing titanium or aluminum to-a predetermined thickness using a magnetron sputtering method or the electron beam deposition method.

The gate is preferably formed by depositing the gate layer and etching the same by a photolithographic method.

The mask forming step preferably includes steps of forming a predetermined photoresist mask on the mask layer and etching the photoresist mask using a chlorine-series reactive ion etching method.

The potential micro-tip portion is preferably formed by etching the cathode layer using the mask by means of $CF_4$-$O_2$ plasma.

The micro-tip is preferably formed by a buffered oxide etching (BOE) method.

The BOE method preferably utilizes a solution of HF and NH4F in the ratio of 7 to 1 up to 10 to 1.

BRIEF DESCRIPTION OF THE DRAWINGS

The above objects and advantages of the present invention will become more apparent by describing in detail a preferred embodiment thereof with reference to the attached drawings in which:

FIGS. 2A and 2B show the conventional horizontal field emission device, in which FIG. 2A is a vertical cross-section thereof and FIG. 2B is a plan view thereof;

FIGS. 3A and 3B show a field emission device according to the present invention, in which FIG. 3A is a vertical cross-section thereof and FIG. 3B is a partly exploded perspective view thereof;

DETAILED DESCRIPTION OF THE INVENTION

Figure 1:
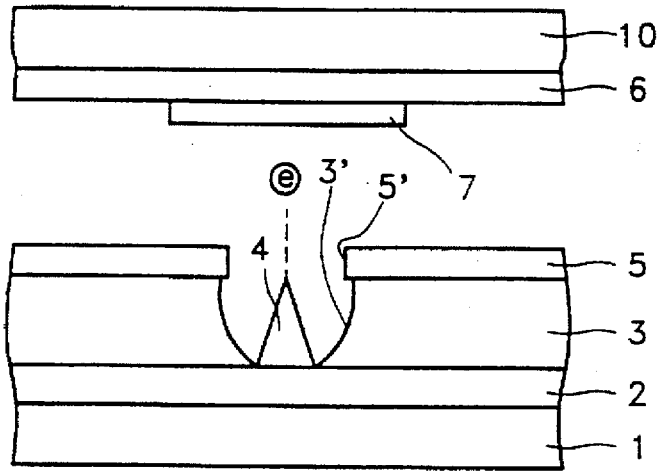
FIG.1 (PRIOR ART)
FIG. 1 is a vertical cross-section of a conventional horizontal field emission device.
Figure 2A:
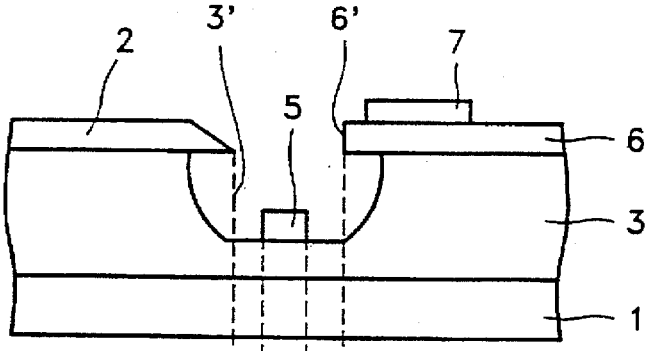
FIG.2A (PRIOR ART)
Figure 2B:
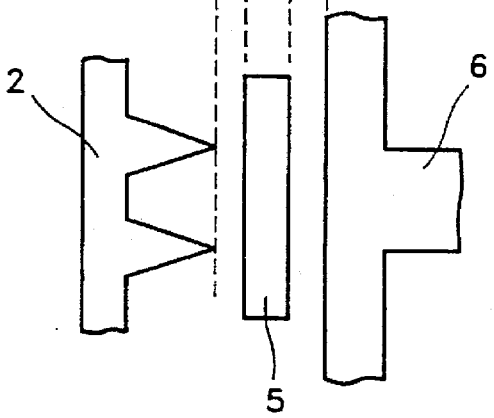
FIG.2B (PRIOR ART)

The structure of the field emission device according to the present invention will now be described with reference to FIGS. 3A and 3B.

The field emission device according to the present invention has a structure in which an adhesive layer 12, a cathode 13, a micro-tip 13', a mask 14, an insulating layer 15 and a gate 18 are sequentially deposited in a striped pattern. Here, micro-tip 13' is successively protruded upwardly on cathode 13 in an array shape. Adhesive layer 12 is formed by depositing titanium or aluminum to a thickness of 2,000Å, in which it is rather more advantageous to use titanium than to use aluminum. This is because the etching rate of titanium is faster than that of aluminum. Cathode 13 is formed by depositing tungsten to a thickness of 1 μm. Micro-tip 13' is formed so as to be protruded upwardly 60°~70° by patterning a part of cathode 13 in a triangular shape. Mask layer 14 is formed by depositing and patterning titanium or aluminum, like adhesive layer 12, in which it is rather more advantageous to use aluminum whose etching rate is slightly lower than that of titanium, to a thickness of 1,500~2,000Å. Insulating layer 15 isolates cathode 13 and gate 18 electrically. Gate 18 is formed by depositing chromium and patterning the same.

Tungsten (W) which is a material for cathode 13 positioned between adhesive layer 12 made of titanium and mask layer 14 made of aluminum, has a strong internal stress difference therebetween. Also, tungsten (W) is hardly etched while titanium and aluminum are etched. Since the etching rate of titanium is higher than that of aluminum, lower adhesive layer 12 is preferably made of titanium, and upper mask 14 is preferably made of aluminum. Micro-tip 13' is protruded upwardly by the internal stress while instantaneously etching the adhesive layer in the lower portion of the triangular micro-tip patterned utilizing the severe etching rate difference and the internal stress difference among cathode, adhesive layer and mask layer.

Figure 3A:
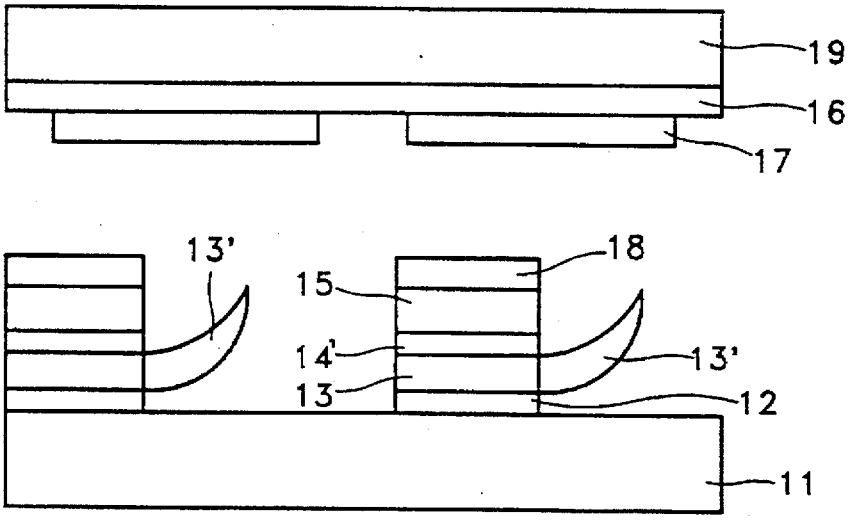

Above micro-tip 13' is provided a front substrate 19 wherein an anode 16 is formed in a striped pattern across cathode 13, as shown in FIG. 3A, thereby completing the device.

The method of fabricating the field emission device having the aforementioned structure will now be described.

Figure 4A:
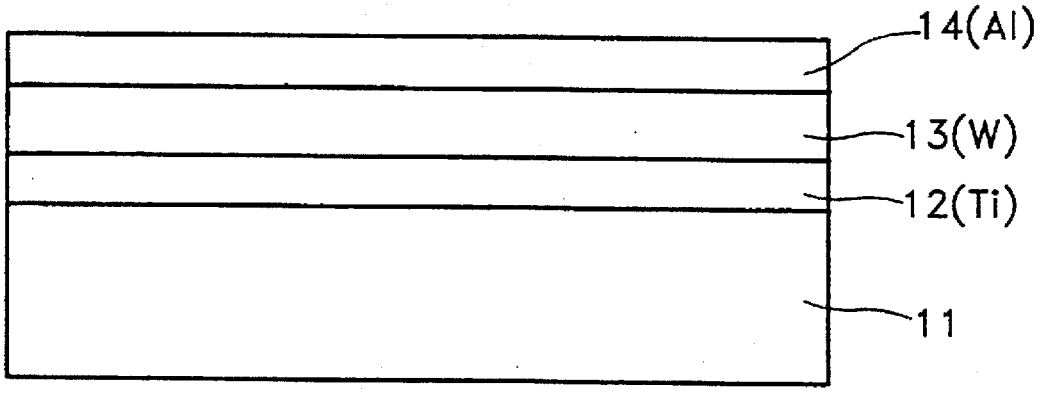
FIGS. 4A to 4F are vertical cross-sections showing a process of fabricating the field emission device according to the present invention.

First, as shown in FIG. 4A, titanium (Ti) is deposited on a glass substrate 11 to a thickness of about 2,000Å to then form an adhesive layer 12. Thereafter, tungsten (W) is deposited to a thickness of 1 μm using a DC-magnetron sputtering method to then form a cathode layer 13. Then, aluminum (Al) is deposited to a thickness of 1,500–2,000Å using a DC-magnetron sputtering method or electron beam deposition method to then form a mask layer 14. Here, the thus-formed cathode layer 13 has a very strong internal stress depending on the processing conditions. The strong internal stress is latent until it is used in protruding the micro-tip 13' of cathode layer 13 upwardly to a very strong extent during rapid etching of adhesive layer 12.

Figure 4B:
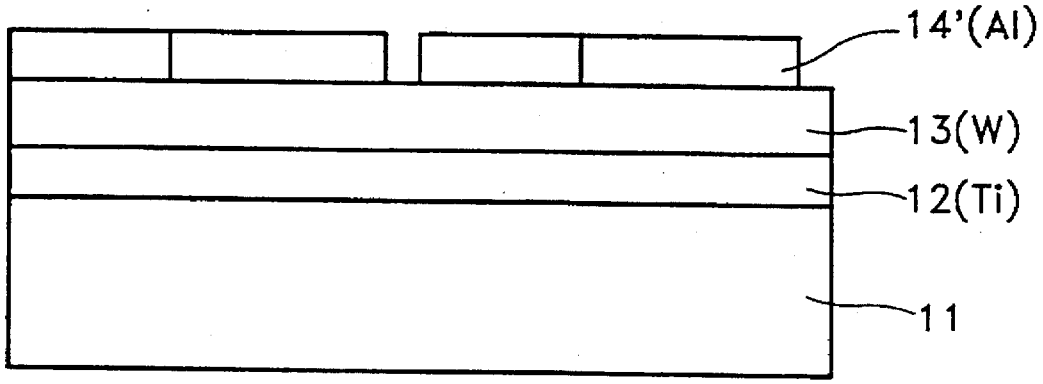
Figure 6:
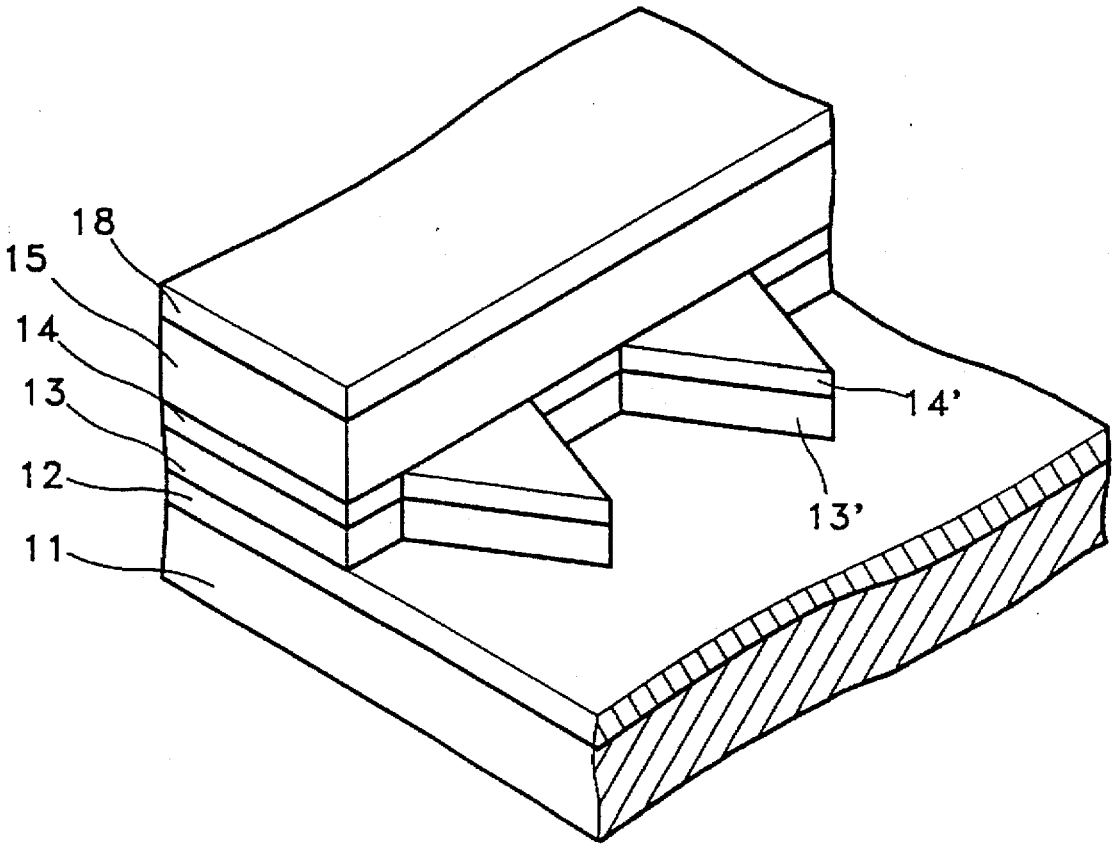
FIG. 6 is a perspective view showing the appearance of the field emission device before a micro-tip is protruded.

Next, as shown in FIG. 4B, Al mask layer 14 is etched using a reactive ion etching (RIE) method to then form a mask 14' for forming a micro-tip. At this time, the plan view of mask 14' is sharp triangle shaped, as shown in FIG. 6, and the sharpness of the tip to be formed is dependent on the shape of mask 14'.

Figure 4C:
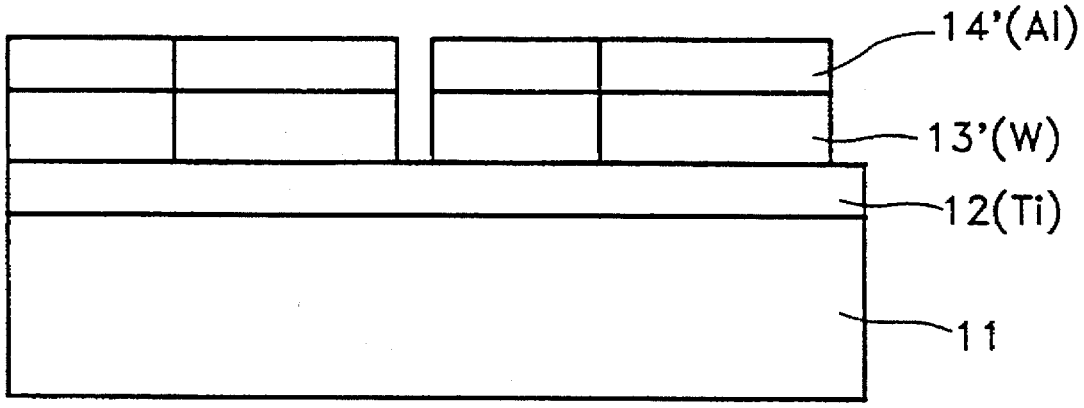

Then, as shown in FIG. 4C, tungsten cathode layer 13 is selectively etched using Al mask 14' by means of $CF_4$-$O_2$ plasma, to then form a micro-tip 13.

Figure 4D:
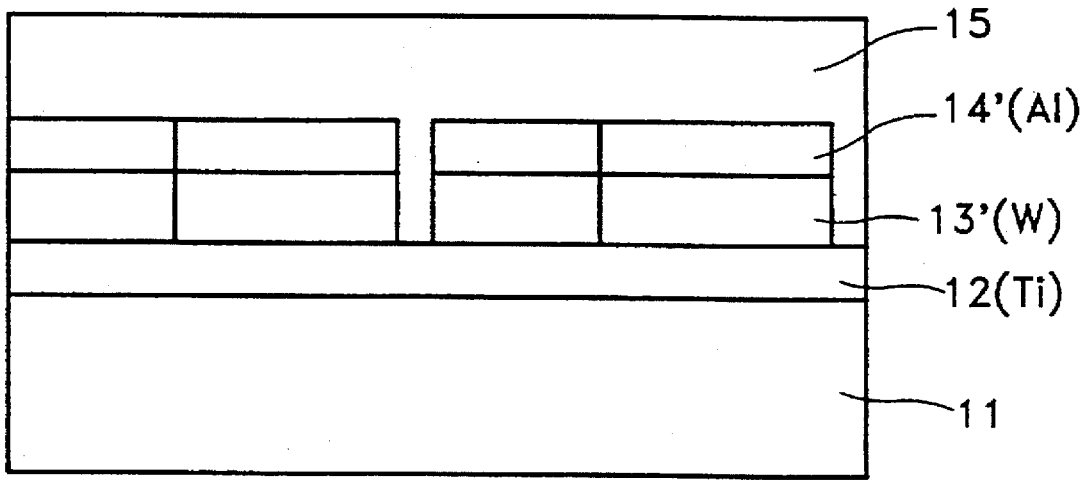
Figure 4E:
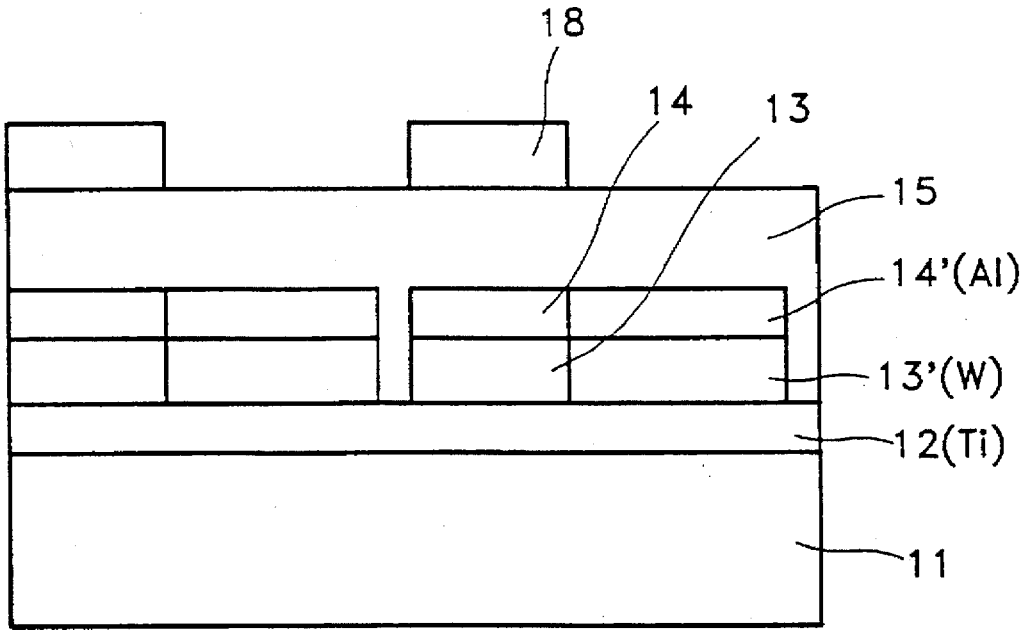

As shown in FIG. 4D, an insulating layer 15 is formed on triangular mask 14' and micro-tip 13'. Then, as shown in FIG. 4E, chromium is deposited and patterned to form a gate 18.

Figure 4F:
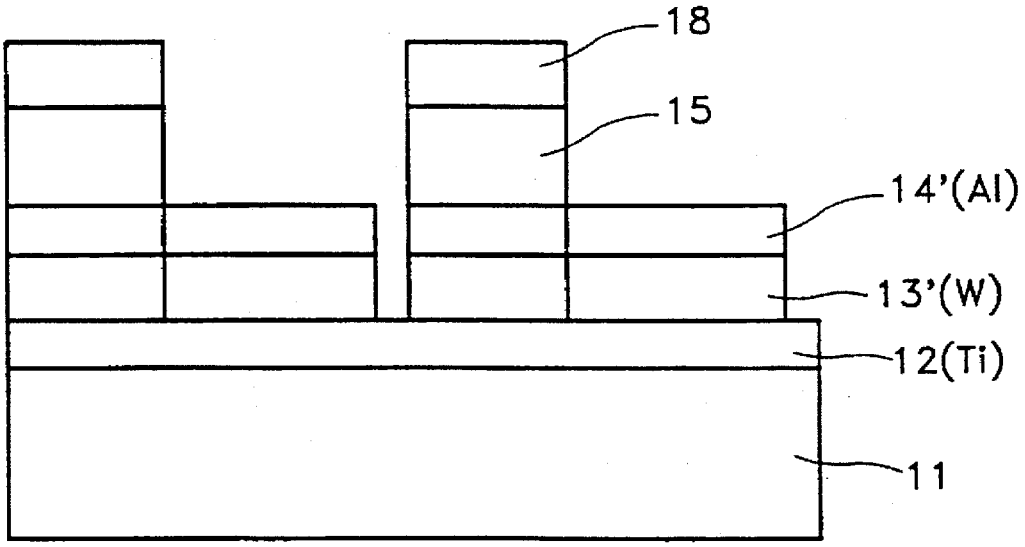

Next, as shown in FIG. 4F, insulating layer 15 is selectively etched using gate 18 as a mask to expose the previously formed Al mask 14' and micro-tip 13'.

Figure 3B:
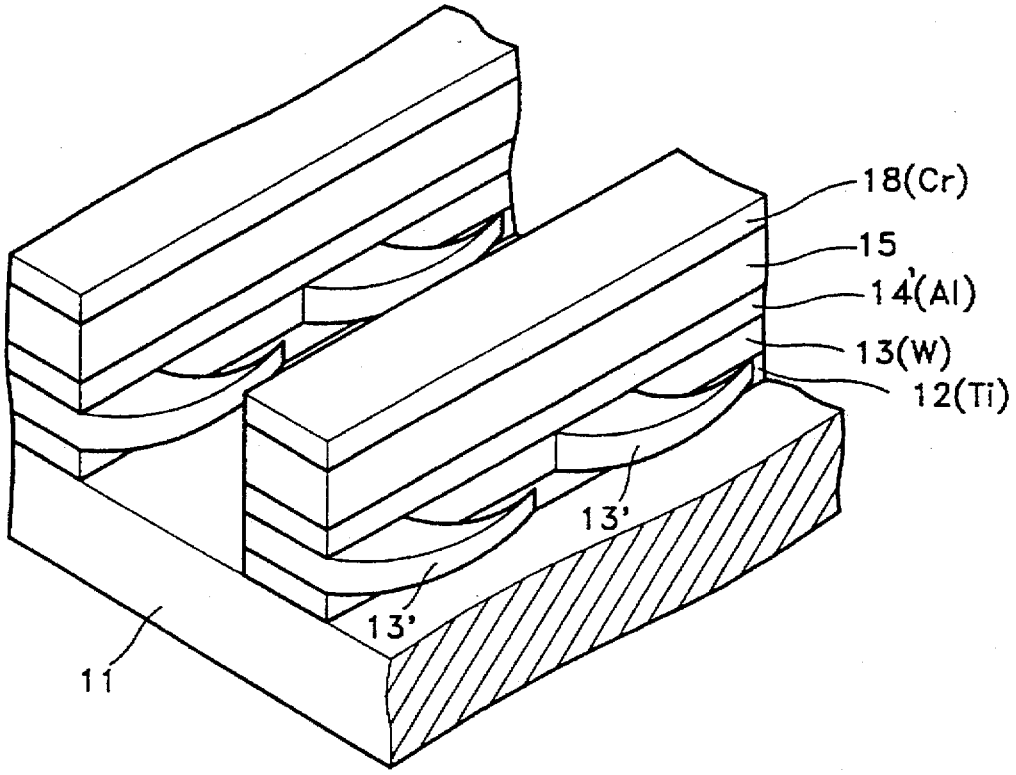

As shown in FIGS. 3A and 3B, micro-tip 13' is formed by selectively etching Ti adhesive layer 12 and Al mask 14' instantaneously using BOE method applied to the exposed mask 14' and micro-tip 13'. At this time, if adhesive layer 12 is instantaneously etched, micro-tip 13' is protruded upwardly by the internal stress of tungsten. Since the etching rate of Ti adhesive layer 12 is very rapid, it is important to control the etching to be finished in a short time. At this time, the etchant used in BOE method is a solution of HF and $NH_4F$ in the ratio of 7 to 1 up to 10 to 1.

Next, a front substrate 19 spaced apart from rear substrate 11 wherein micro-tip 13' is formed and having a striped anode 16 being across cathode 13 on the opposite plane of rear substrate 11, is disposed, and its edges are air-tightly sealed to make the inside thereof vacuum, thereby completing the device. At this time, the vacuum extent is at least $10^{-6}$ torr.

Also, another method of fabricating the field emission device having the aforementioned structure according to the present invention will now be described.

Figure 5A:
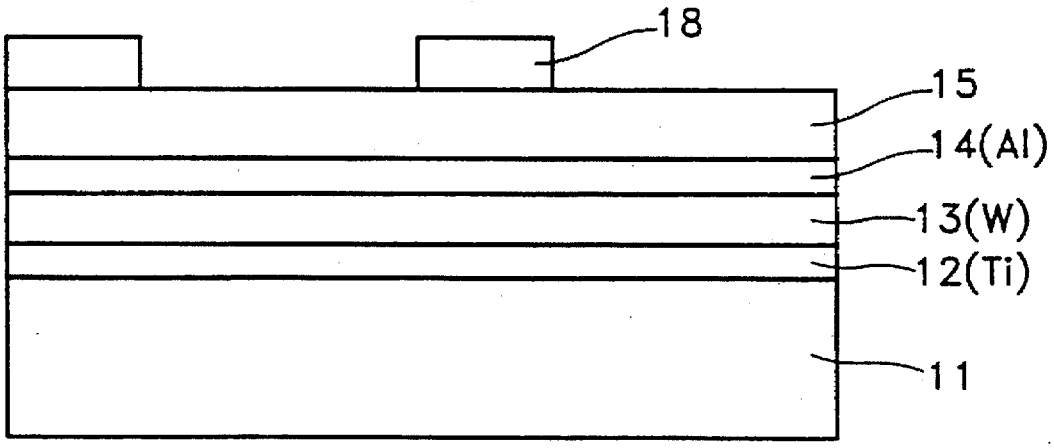
FIGS. 5A to 5D are vertical cross-sections showing another process of fabricating the field emission device according to the present invention.

First, as shown in FIG. 5A, titanium (Ti) is deposited on a glass substrate 11 to a thickness of about 2,000Å to then form an adhesive layer 12. Thereafter, tungsten (W) is deposited to a thickness of 1 μm using a DC-magnetron sputtering method to then form a cathode layer 13. Then, aluminum (Al) is deposited to a thickness of 1,500~2,000Å using a DC-magnetron sputtering method or electron beam deposition method to then form a mask layer 14. Then, an insulating layer 15 is formed, and a lift-off method is performed with respect therewith to form a chromium gate 18. Otherwise, a chromium layer is formed by a deposition method and then is patterned using a photolithographic etching method to form a gate 18.

Figure 5B:
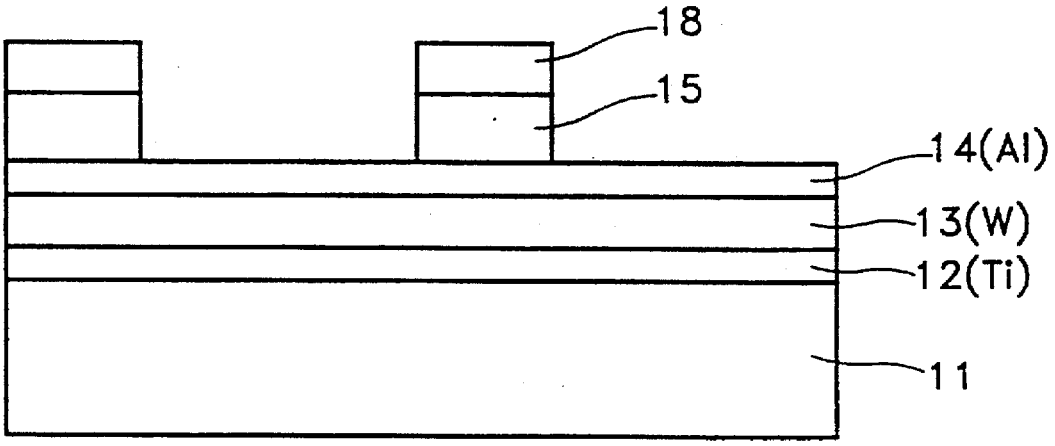

Next, as shown in FIG. 5B, insulating layer 15 is selectively etched using gate 18 as a mask to expose Al mask layer 14.

Figure 5C:
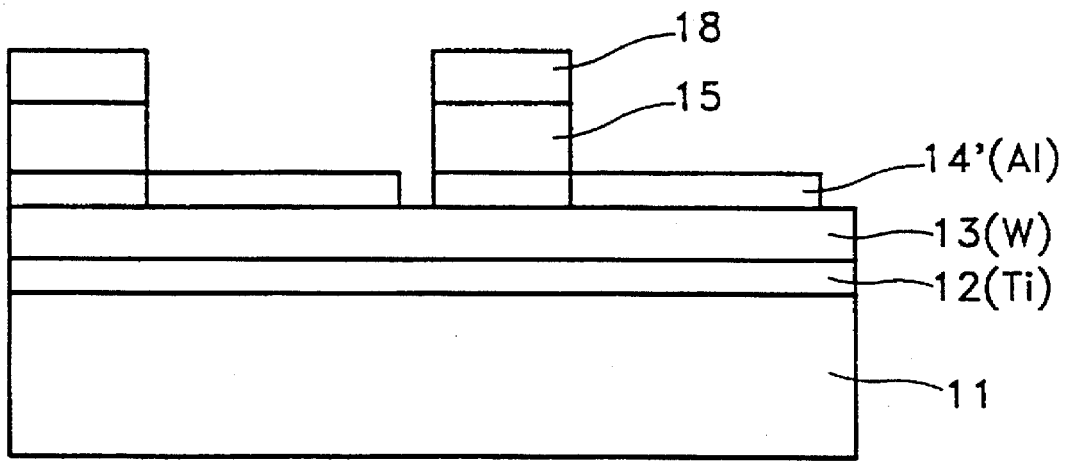

Then, as shown in FIG. 5C, Al mask layer 14 is etched using a reactive ion etching (RIE) method to then form a mask 14' for forming a micro-tip. At this time, the plan view of mask 14' is sharp triangle shaped, as shown in FIG. 6, and the sharpness of the tip to be formed is dependent on the method of patterning mask 14'.

Figure 5D:
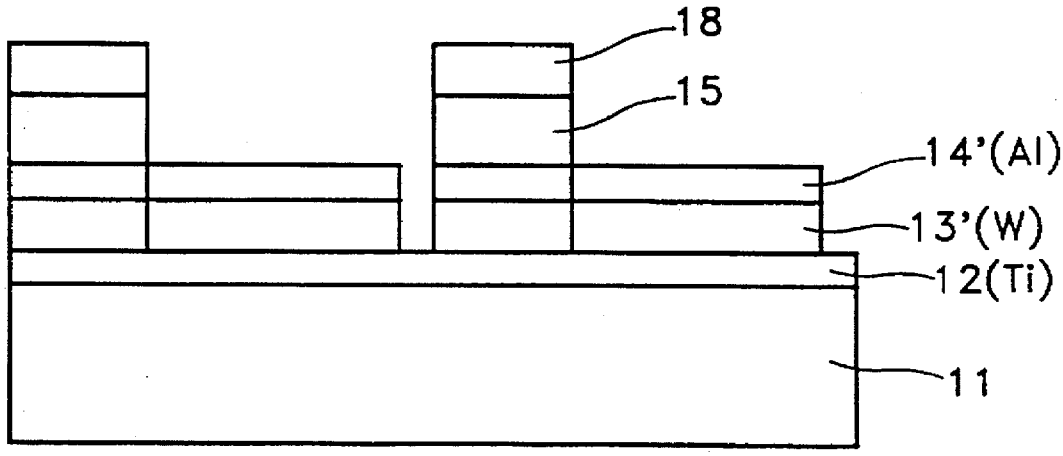

Then, as shown in FIG. 5D, tungsten cathode layer 13 is selectively etched using Al mask 14' by means of $CF_4$-$O_2$ plasma, to then form a micro-tip 13.

As shown in FIGS. 3A and 3B, in the same manner with the above-described fabrication method, micro-tip 13' is formed by selectively etching Ti adhesive layer 12 and Al mask 14' instantaneously using BOE method applied to the exposed mask 14' and micro-tip 13'. Thereafter, a front substrate 19 spaced apart from rear substrate 11 wherein micro-tip 13' is formed and having a striped anode 16 being across cathode 13 on the opposite plane of rear substrate 11, is disposed, and its edges are air-tightly sealed to make the inside thereof vacuum, thereby completing the device.

Figure 7:
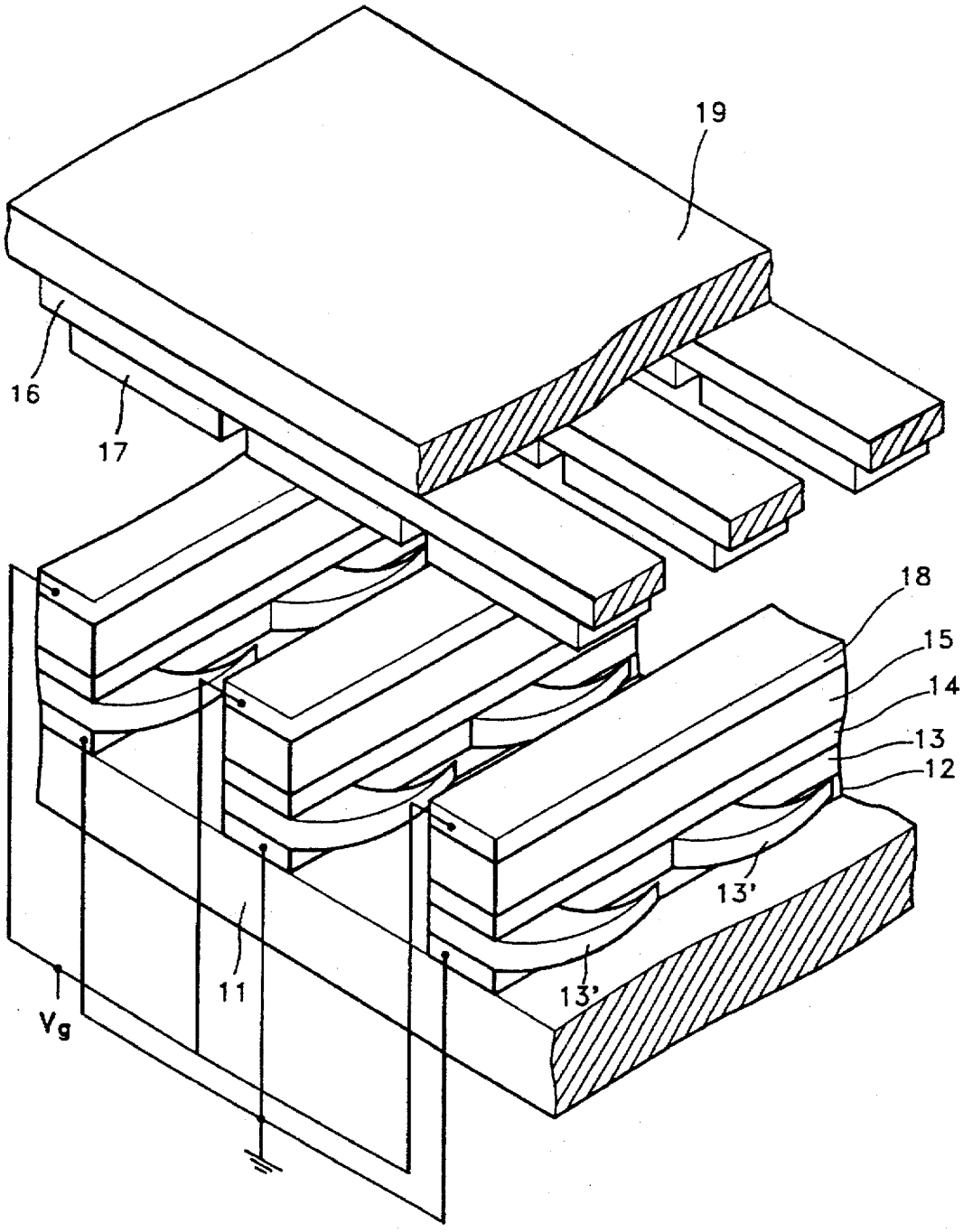
FIG. 7 is a partly exploded perspective view showing an array structure of the field emission device according to the present invention.

As shown in FIG. 7, according to the field emission device fabricated in the above-described two methods, if cathode 13 being on rear substrate 11 is grounded, a proper control voltage Vg is applied to gate 18 for scanning, and a proper power voltage Va is applied to anode 16, electrons are emitted from tungsten micro-tip 13' protruded by the strong electric field effect applied to gate, by quantum mechanical penetration effect. At this time, electrons penetrate vacuum space provided by anode and cathode spaced apart from each other, whose edges are sealed. The emitted electrons passing through the vacuum state strike a fluorescent body 17 to emit light, thereby obtaining a desired image. The field emission device illustrated and thus far fabricated can be applied to a flat panel display, a ultra-high-frequency-microwave-applied device, an electron-beam-applied scanning electron microscope, an electron-beam-applied system device, or a multiple-beam-emission sensor.

As described above, in the field emission device and the fabrication method thereof according to the present invention, a micro-tip is fabricated such that the etching rate differences among tungsten cathode, lower titanium adhesive layer and upper aluminum mask, and the internal stress differences are made to be very large, and thus, tungsten micro-tip is protruded by the internal stress when adhesive layer and mask are instantaneously etched. Since the micro-tip size is easily adjusted, and the internal stress of tungsten and characteristics of BOE method are utilized throughout the fabricating process, the reproducibility is ensured.

What is claimed is:

1. A method of fabricating a field emission device comprising the steps of:

a) sequentially depositing on a rear substrate an adhesive layer formed of a material etchable at a first etching rate with respect to a predetermined etchant, a cathode layer formed of a metal which is not etched by said etchant and having an internal stress with respect to said adhesive layer higher than a predetermined magnitude, and a mask layer formed of a material etchable at a second etching rate lower than said first etching rate with respect to said etchant;

b) forming a triangular mask by patterning said mask layer;

c) forming a striped cathode pattern having a potential micro-tip portion by etching an exposed portion of said cathode layer using said mask;

d) forming an insulating layer on said rear substrate where said mask and said potential micro-tip portion are formed;

e) forming a gate on said insulating layer using a lift-off method;

f) exposing said mask and said potential micro-tip portion by selectively etching said insulating layer using said gate as a mask; and g) forming a micro-tip by protruding said potential micro-tip portion due to the internal stress by etching, within a predetermined time, said adhesive layer and said mask, each being below and above said potential micro-tip portion.

2. A method of fabricating a field emission device as claimed in claim 1, wherein said adhesive layer is formed by depositing one of titanium and aluminum to a predetermined thickness.

3. A method of fabricating a field emission device as claimed in claim 1, wherein said cathode layer is formed by depositing one of tungsten to a predetermined thickness using one of a DC magnetron sputtering method and an electron beam deposition method.

4. A method of fabricating a field emission device as claimed in claim 1, wherein said mask layer is formed by depositing one of titanium and aluminum to a predetermined thickness using one of a magnetron sputtering method and an electron beam deposition method.

5. A method of fabricating a field emission device as claimed in claim 1, wherein said mask forming step includes the steps of forming a predetermined photoresist mask on said mask layer and etching said photoresist mask using a chlorine-series reactive ion etching method.

6. A method of fabricating a field emission device as claimed in claim 1, wherein said mask is formed by a lift-off method.

7. A method of fabricating a field emission device as claimed in claim 1, wherein said potential micro-tip portion is formed by etching said cathode layer using said mask by means of $CF_4$-$O_2$ plasma.

8. A method of fabricating a field emission device as claimed in claim 1, wherein said gate is formed by depositing a gate layer and etching the same by a photolithographic method.

9. A method of fabricating a field emission device as claimed in claim 1, wherein, in said step (g), a buffered oxide etching (BOE) method is used.

10. A method of fabricating a field emission device as claimed in claim 9, wherein said BOE method utilizes a solution of HF and NH4F in a ratio of 7 to 1 up to 10 to 1.

11. A method of fabricating a field emission device comprising the steps of:

a) sequentially depositing on a rear substrate an adhesive layer formed of a material etchable at a first etching rate with respect to a predetermined etchant, a cathode layer formed of a metal which is etched by said etchant and having an internal stress with respect to said adhesive layer higher than a predetermined magnitude, a mask layer formed of a material etchable at a second etching rate lower than said first etching rate with respect to said etchant, an insulating layer, and a gate layer;

b) forming gates having the striped pattern by patterning said gate layer;

c) selectively etching said insulating layer using said gates as a mask;

d) forming a triangular mask by patterning said mask layer;

e) forming a striped cathode pattern having a potential micro-tip portion by etching the exposed portion of said cathode layer using said mask; and f) forming a micro-tip by protruding said potential micro-tip portion due to the internal stress by etching, within a predetermined time, said adhesive layer and said mask, each being below and above said potential micro-tip.

12. A method of fabricating a field emission device as claimed in claim 11, wherein said adhesive layer is formed by depositing titanium to a predetermined thickness.

13. A method of fabricating a field emission device as claimed in claim 11, wherein said adhesive layer is formed by depositing aluminum to a predetermined thickness.

14. A method of fabricating a field emission device as claimed in claim 11, wherein said cathode layer is formed by depositing tungsten to a predetermined thickness using a magnetron sputtering method.

15. A method of fabricating a field emission device as claimed in claim 11, wherein said cathode layer is formed by depositing tungsten to a predetermined thickness using an electron beam deposition method.

16. A method of fabricating a field emission device as claimed in claim 11, wherein said mask layer is formed by depositing titanium to a predetermined thickness using a magnetron sputtering method.

17. A method of fabricating a field emission device as claimed in claim 11, wherein said mask layer is formed by depositing titanium to a predetermined thickness using the electron beam deposition method.

18. A method of fabricating a field emission device as claimed in claim 11, wherein said mask layer is formed by depositing aluminum to a predetermined thickness using the magnetron sputtering method.

19. A method of fabricating a field emission device as claimed in claim 11, wherein said mask layer is formed by depositing aluminum to a predetermined thickness using the electron beam deposition method.

20. A method of fabricating a field emission device as claimed in claim 11, wherein said gate is formed by etching said gate layer by a photolithographic method.

21. A method of fabricating a field emission device as claimed in claim 11, wherein said mask forming step includes the steps of forming a predetermined photoresist mask on said mask layer and etching said photoresist mask using a chlorine-series reactive ion etching method.

22. A method of fabricating a field emission device as claimed in claim 11, wherein said potential micro-tip portion is formed by etching said cathode layer using said mask by means of $CF_4$-$O_2$ plasma.

23. A method of fabricating a field emission device as claimed in claim 11, wherein, in said step (f), a buffered oxide etching (BOE) method is used.

24. A method of fabricating a field emission device as claimed in claim 23, wherein said BOE method utilizes a solution of HF and NH4F in a ratio of 7 to 1 up to 10 to 1.

25. A field emission display device formed according to the method of claim 1.

26. A field emission display device formed according to the method of claim 11.

27. A method of fabricating a field emission device, as recited in claim 1, further comprising the step of:

forming an anode having a striped pattern perpendicular to the striped pattern of said cathode layer, on a surface of a front substrate, said front substrate being arranged with the surface opposed to said rear substrate where said micro-tip is formed at a predetermined distance, edges of the device being sealed and the internal air being exhausted to provide a vacuum state.

28. A method of fabricating a field emission device, as recited in claim 11, further comprising the step of:

forming an anode having a striped pattern perpendicular to the striped pattern of said cathode layer, on a surface of a front substrate, said front substrate being arranged with the surface opposed to said rear substrate where said micro-tip is formed at a predetermined distance, edges of the device being sealed and the internal air being exhausted to provide a vacuum state.

* * * * *